US010047669B2

(12) United States Patent
Watanabe

(10) Patent No.: US 10,047,669 B2
(45) Date of Patent: Aug. 14, 2018

(54) INTERNAL COMBUSTION ENGINE

(71) Applicant: TOYOTA JIDOSHA KABUSHIKI KAISHA, Toyota-shi, Aichi-ken (JP)

(72) Inventor: Masaki Watanabe, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/648,905

(22) Filed: Jul. 13, 2017

(65) Prior Publication Data

US 2018/0016973 A1 Jan. 18, 2018

(30) Foreign Application Priority Data

Jul. 15, 2016 (JP) ..... 2016-140591
Jun. 27, 2017 (JP) ..... 2017-125512

(51) Int. Cl.

*F02B 75/04* (2006.01)
*F02F 7/00* (2006.01)
*F02B 75/20* (2006.01)
*F02B 75/18* (2006.01)

(52) U.S. Cl.

CPC ..... *F02B 75/041* (2013.01); *F02F 7/0007* (2013.01); *F02B 75/20* (2013.01); *F02B 2075/1816* (2013.01)

(58) Field of Classification Search

CPC ..... F02B 75/041; F02B 75/04; F02B 75/20; F02B 2075/1816; F02F 7/0007

See application file for complete search history.

(56) References Cited

U.S. PATENT DOCUMENTS 5,329,893 A * 7/1994 Drangel ..... F02B 75/041 123/195 C
5,611,301 A * 3/1997 Gillbrand ..... F02B 75/047 123/195 C
2010/0229834 A1* 9/2010 Pattakos ..... F02B 75/041 123/48 AA

FOREIGN PATENT DOCUMENTS

JP 2012-219745 A 11/2012

* cited by examiner

*Primary Examiner* — Jacob Amick
(74) *Attorney, Agent, or Firm* — Hunton Andrews Kurth LLP

(57) ABSTRACT

An internal combustion engine provided with a cylinder block able to move relative to a crankcase is provided with a block movement mechanism arranged just at one side of the internal combustion engine, a pair of guide walls provided at the crankcase, a support member supporting a side surface of the cylinder block, and a pushing member pushing against a side surface of the cylinder block. Further, at the guide wall at the side of arrangement of the block movement mechanism, the support member is attached to the top side from the position of attachment of the other end part of the connecting member and the pushing member is attached to the bottom side from the position of attachment of the other end part of the connecting member, while at the guide wall at the opposite side from the side of arrangement of the block movement mechanism, the support member is attached to the bottom side (bottom side of cylinder block) a predetermined space from pushing member.

3 Claims, 11 Drawing Sheets

INTERNAL COMBUSTION ENGINE

CROSS-REFERENCE TO RELATED APPLICATION

This application claims priority based on Japanese Patent Application Nos. 2016-140591 and 2017-125512 filed with the Japan Patent Office on Jul. 15, 2016 and Jun. 27, 2017, respectively, the entire contents of which are incorporated into the present specification by reference.

Technical Field

The present disclosure relates to an internal combustion engine.

Bacground Art

JP2012-219745A discloses, as a conventional internal combustion engine provided with a cylinder block able to move relative to a crankcase, an engine provided with two eccentric shafts (camshafts) arranged at the two sides of the internal combustion engine, one drive shaft for making the eccentric shafts rotate in opposite directions from each other to make the cylinder block move relatively, and an actuator for making the drive shaft rotate. In such a conventional internal combustion engine, to keep the cylinder block from tilting in a direction different from the direction of relative movement, one side surface of the cylinder block was pushed against by a pushing member (biasing mechanism) and the other side surface of the cylinder block was supported by a support member.

SUMMARY OF THE DISCLOSURE

In this way, a conventional internal combustion engine had to be provided with eccentric shafts at the two sides of the internal combustion engine and furthermore be provided with a drive shaft so as to make the eccentric shafts rotate in opposite directions from each other. For this reason, there was the problem that the internal combustion engine as a whole became enlarged and the weight of the internal combustion engine increased.

Further, when pushing one side surface of the cylinder block by a pushing member and supporting another side surface by a support member, when moving the cylinder block, resistance (sliding resistance) is generated between the side surfaces of the cylinder block and the abutting surfaces of the pushing member and support member abutting against the side surfaces of the cylinder block.

Here, for example, if providing a single eccentric shaft in a conventional internal combustion engine and arranging the eccentric shaft at just one side of the internal combustion engine so as to suppress enlargement of the internal combustion engine and suppress increase of weight, when trying to make the cylinder block move, the cylinder block will easily tilt in a direction different from the direction of relative movement. To keep the cylinder block from tilting in a direction different from the direction of relative movement, during operation of the internal combustion engine, it is necessary to push against the cylinder block by a pushing member by a pushing force of the load input from the cylinder block side to the pushing member or more. However, the larger the pushing force by the pushing member, the greater the forces of the pushing member and the support member sandwiching the cylinder block. For this reason, there is the problem that the sliding resistance when moving the cylinder block becomes larger and the load when moving the cylinder block, that is, the load applied to the actuator, increases.

The present disclosure was made focusing on such a problem and has as its object to suppress enlargement of an internal combustion engine provided with a cylinder block able to move relative to a crankcase to suppress increase of weight and to keep the cylinder block from tilting in a direction different from the direction of relative movement while keeping down the load when moving the cylinder block.

To solve this problem, according to one aspect of the present disclosure, there is provided an internal combustion engine including a cylinder block able to move relative to a crankcase and a cylinder head attached to a top part of the cylinder block, which internal combustion engine comprising a block movement mechanism arranged at only one side of the internal combustion engine when viewing the internal combustion engine from an axial line direction of the crankshaft supported at the crankcase to be able to freely rotate and making the cylinder block move relative to the crankcase, a pair of guide walls provided at the crankcase so as to face side surfaces of the cylinder block, support members attached to the guide wall at the side of arrangement of the block movement mechanism and the guide wall at the opposite side and supporting the side surfaces of the cylinder block, and pushing members attached to the guide wall at the side of arrangement of the block movement mechanism and the guide wall at the opposite side and pushing the side surfaces of the cylinder block. The block movement mechanism is provided with a single control shaft supported by the crankcase and having a main shaft part and an eccentric part with an axial center at a position offset by a predetermined amount from the axial center of the main shaft part, a connecting member with one end part attached to the eccentric part and with the other end part attached to the cylinder block and connecting the control shaft and the cylinder block, and an actuator making the control shaft rotate in two directions within a predetermined range of rotational angle to make the axial center of the eccentric part swing in the direction of relative movement of the cylinder block about the axial center of the main shaft part. At the guide wall at the side of arrangement of the block movement mechanism, the support member is attached to the top side of the cylinder block from the position of attachment of the other end part of the connecting member and the pushing member is attached to the bottom side of the cylinder block from the position of attachment of the other end part of the connecting member, while at the guide wall at the opposite side to the side of arrangement of the block movement mechanism, the support member is attached to the bottom side of the cylinder block a predetermined space away from the pushing member in the direction of relative movement of the cylinder block.

According to this aspect of the present disclosure, it is possible to suppress enlargement of the internal combustion engine provided with a cylinder block able to move relative to a crankcase and suppress an increase in weight and possible to keep the cylinder block from tilting in a direction different from the direction of relative movement while keeping down the load at the time of moving the cylinder block.

DESCRIPTION OF EMBODIMENTS

Figure 1:
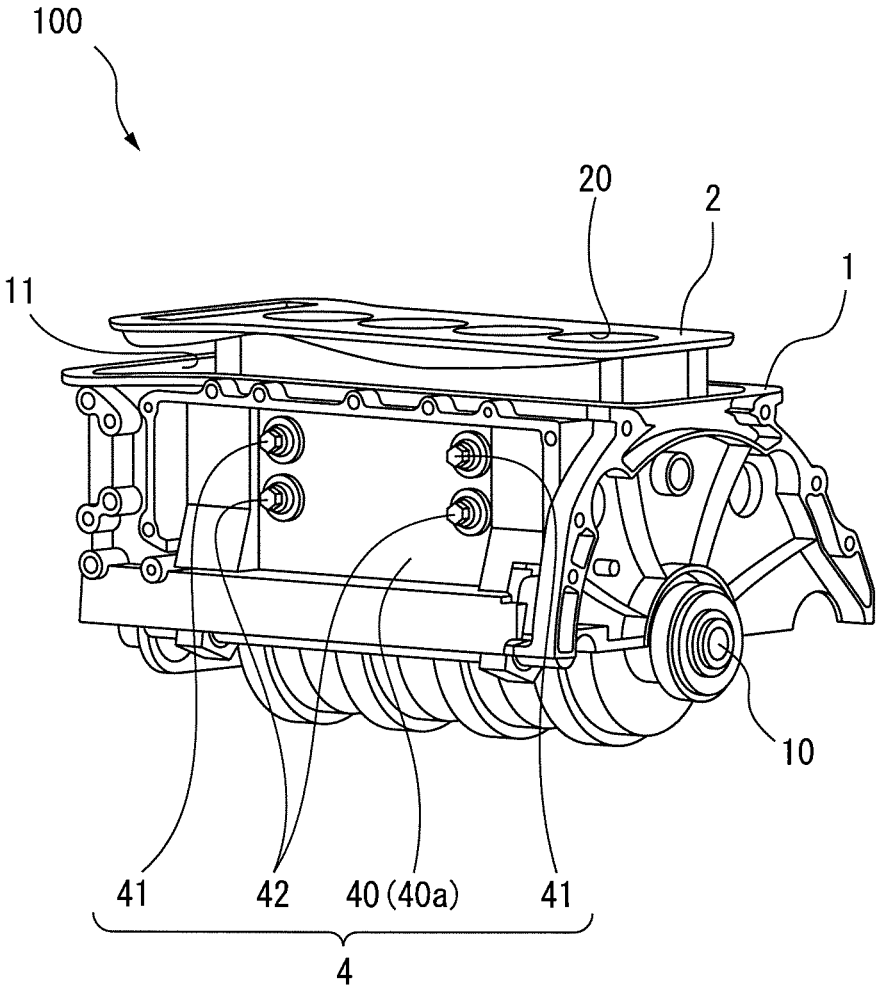
FIG. 1 is a schematic perspective view of an internal combustion engine according to one embodiment of the present disclosure.

Below, referring to the drawings, an embodiment of the present disclosure will be explained in detail. Note that, in the following explanation, similar components will be assigned the same reference numerals.

Figure 2:
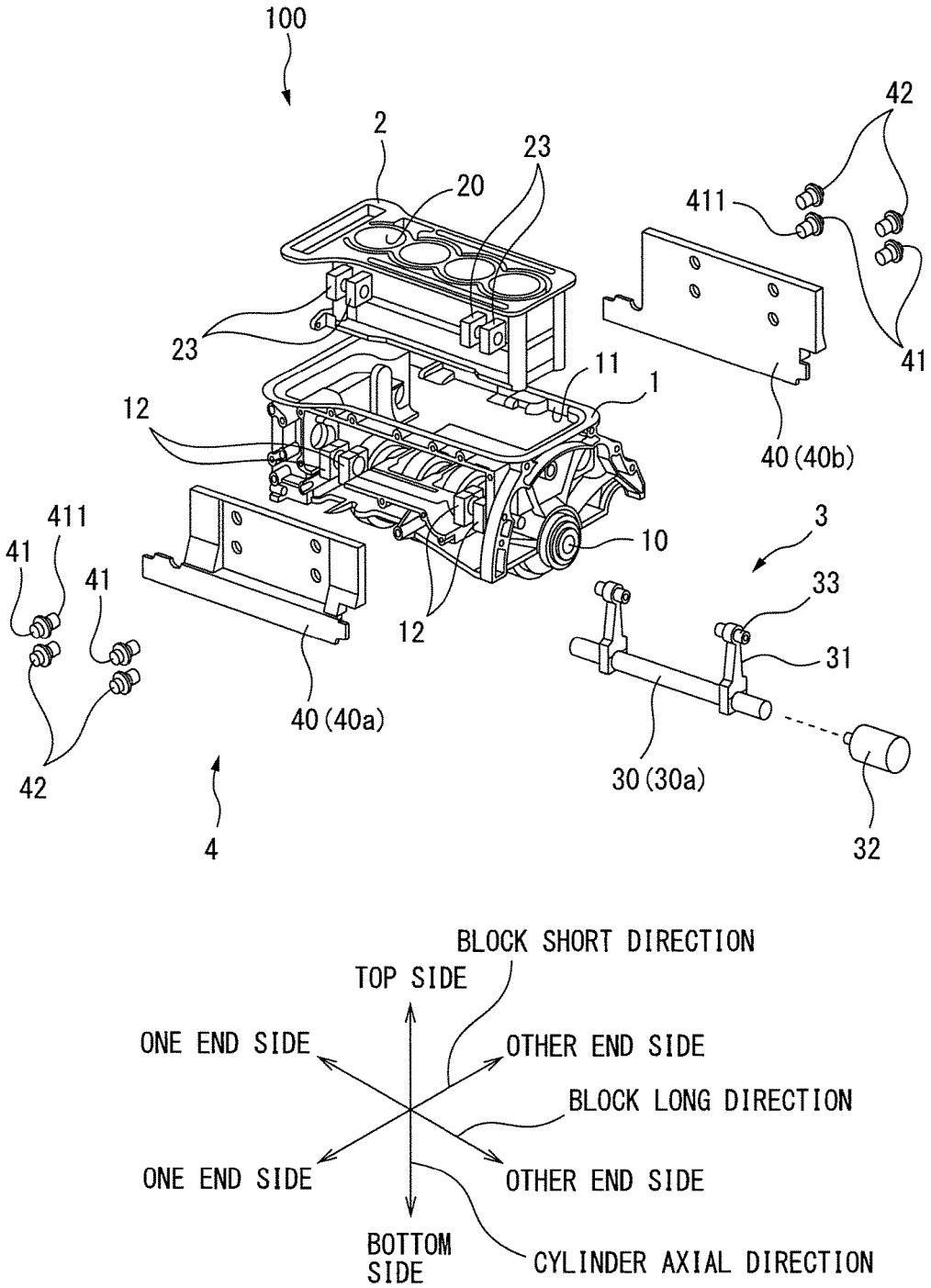
FIG. 2 is a schematic disassembled perspective view of the internal combustion engine shown in FIG. 1.
Figure 3:
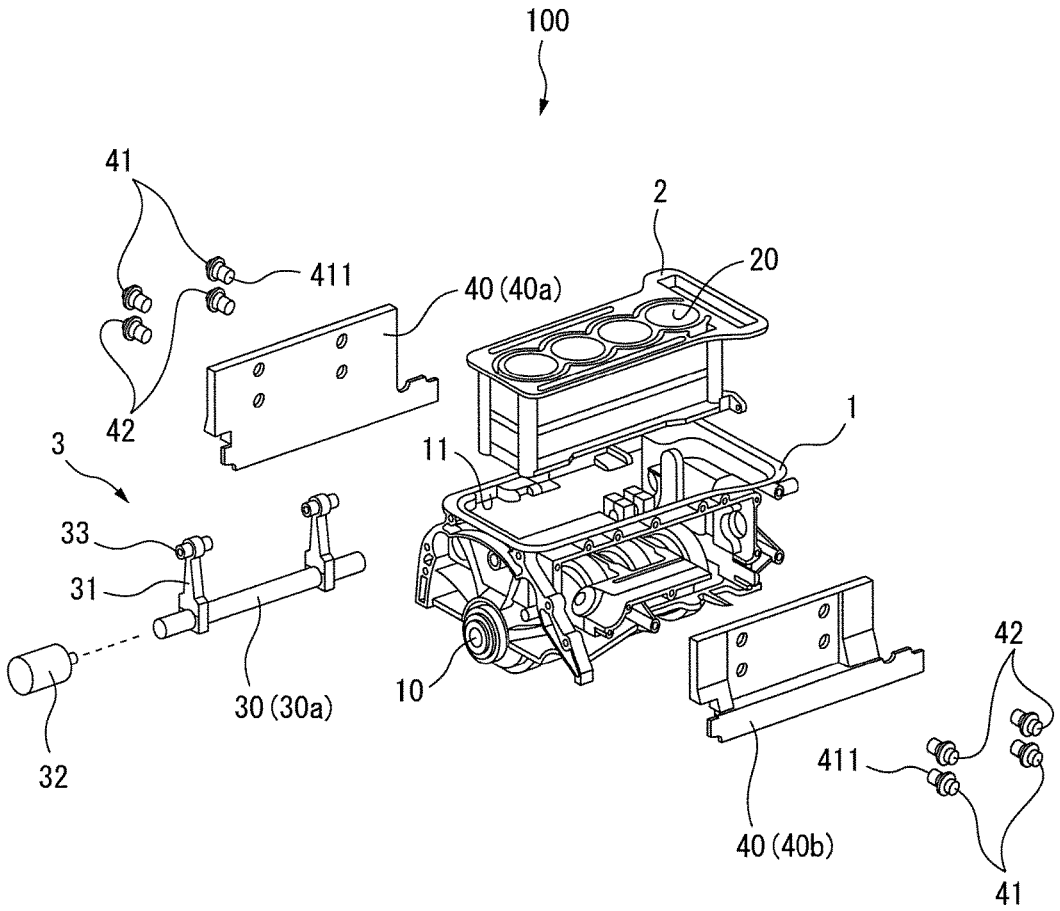
FIG. 3 is a schematic disassembled perspective view of the internal combustion engine shown in FIG. 1.
Figure 3:
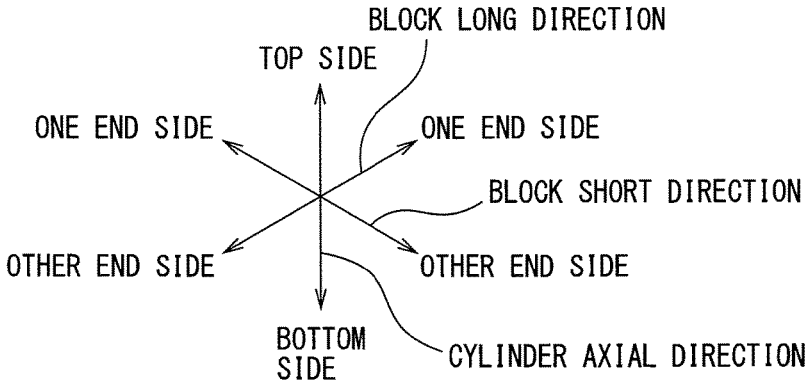

FIG. 1 is a schematic perspective view of an internal combustion engine 100 according to one embodiment of the present disclosure. FIG. 2 and FIG. 3 are schematic disassembled perspective views of the internal combustion engine 100 shown in FIG. 1.

As shown from FIG. 1 to FIG. 3, the internal combustion engine 100 is provided with a crankcase 1, cylinder block 2, block movement mechanism 3, and guide mechanism 4.

The crankcase 1 supports a crankshaft 10 to be able to freely rotate and is provided with a block holding part 11 for holding the cylinder block 2 at the inside.

The cylinder block 2 is made a separate member from the crankcase 1 so as to enable relative movement with respect to the crankcase 1. Part is held inside the block holding part 11 of the crankcase 1. The cylinder block 2 is formed with cylinders 20. In the present embodiment, four cylinders 20 are formed in a line along the longitudinal direction of the cylinder block 2 (below, referred to as the "block long direction").

Below, referring to FIG. 4 in addition to FIG. 1 to FIG. 3, the internal configuration of the internal combustion engine 100 and details of the block movement mechanism 3 and guide mechanism 4 will be explained.

Figure 4:
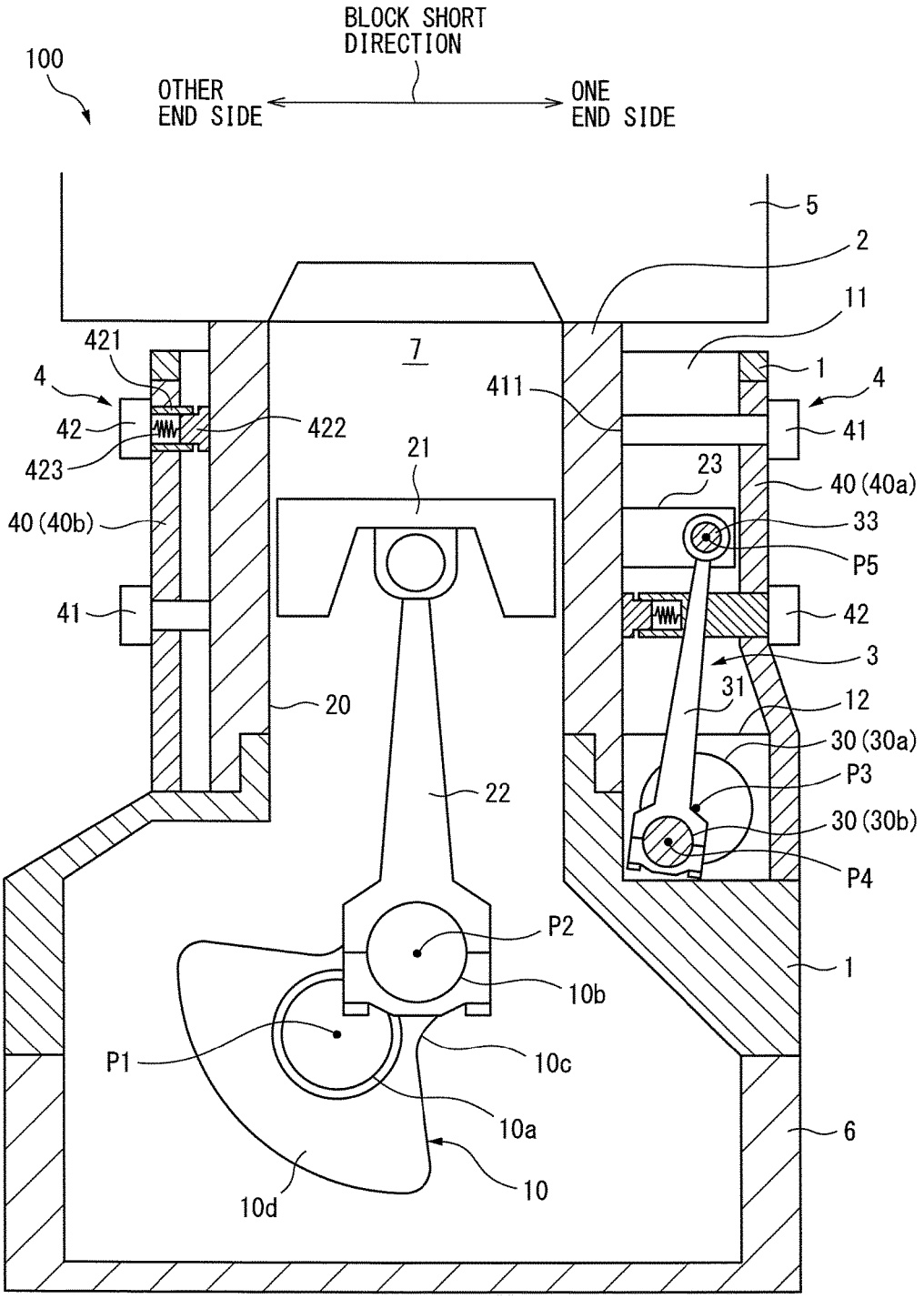
FIG. 4 is a schematic cross-sectional view of an internal combustion engine according to one embodiment of the present disclosure.

FIG. 4 is a schematic cross-sectional view of the internal combustion engine 100. Note that in FIG. 1 to FIG. 3, to prevent the figures from becoming complicated, part of the components are omitted in the internal combustion engine 100 shown in FIG. 4.

As shown in FIG. 4, at the top part of the cylinder block 2, a cylinder head 5 is attached, while at the bottom part of the crankcase 1, an oil pan 6 is attached.

At the inside of each cylinder 20, a piston 21 receiving combustion pressure and moving back and forth at the inside of the cylinder 20 is held. The piston 21 is connected through a connecting rod 22 to the crankshaft 10. Due to the crankshaft 10, the reciprocating motions of the pistons 21 are converted to rotary motion. The spaces defined by the cylinder head 5, cylinders 20, and pistons 21 form the combustion chambers 7.

The crankshaft 10 is provided with crank journals 10*a*, crankpins 10*b*, and crank arms 10*c*.

The crank journals 10*a* are parts supported by the crankcase 1 to be able to freely rotate. The axial centers P1 of the crank journals 10*a* form the center of rotation of the crankshaft 10.

The crankpins 10*b* are parts to which the large end parts of the connecting rods 22 are attached. The axial centers P2 of the crankpins 10*b* are offset from the axial centers P1 of the crank journals 10*a* by exactly predetermined amounts. Therefore, if the crankshaft 10 rotates, the axial centers P2 of the crank pins 10*b* rotate about the axial center P1.

The crank arms 10*c* are parts connecting the crank journals 10*a* and the crank pins 10*b*. In the present embodiment, to make the crankshaft 10 smoothly rotate, the crank arms 10*c* are provided with balance weights 10*d*.

The block movement mechanism 3 is a mechanism for making the cylinder block 2 move relative to the crankcase 1 and, as shown from FIG. 2 to FIG. 4, is provided with a single control shaft 30, connecting members 31, and an actuator 32.

The block movement mechanism 3 according to the present embodiment is configured to be able to move the cylinder block 2 in the cylinder axial direction and change the relative position of the cylinder block 2 with respect to the crankcase 1 in the cylinder axial direction. By making the cylinder block 2 move relative to the crankcase 1 in the cylinder axial direction, it is possible to change only the volumes of the combustion chambers 7 without changing the top dead center positions of the pistons 21. In this way, by changing only the volumes of the combustion chambers 7 without changing the top dead center positions of the pistons 21, it is possible to change the mechanical compression ratio of the internal combustion engine 100. Therefore, the block movement mechanism 3 according to the present embodiment functions as a variable compression ratio mechanism of the internal combustion engine 100. Note that the "mechanical compression ratio" is the compression ratio determined mechanically from the stroke volume of a piston 21 at the time of the compression stroke and the volume of a combustion chamber 7 and is expressed by (combustion chamber volume+stroke volume)/combustion chamber volume.

The control shaft 30 is provided with a main shaft part 30*a* extending in parallel with the crankshaft 10 and supported to be able to rotate by two sets of control bearings 12 (see FIG. 2) provided at the crankcase 1 and eccentric parts 30*b* (see FIG. 4) having axial centers P4 (see FIG. 4) at positions offset from the axial center P3 (see FIG. 4) of the main shaft part 30*a* by exactly predetermined amounts. Therefore, even if making the control shaft 30 rotate one time, the axial centers P4 of the eccentric parts 30*b* rotate one time about the axial center P3 of the main shaft part 30*a*. As shown in FIG. 2 and FIG. 3, in the present embodiment, one each eccentric part 30*b* is provided at one end side and the other end side in the block long direction.

Each connecting member 31 is a member for connecting an eccentric part 30*b* of the control shaft 30 and the cylinder block 2. The connecting member 31 is attached at one end part at the bottom side in the cylinder axial direction (bottom side of cylinder block 2, that is, crankshaft 10 side) to an eccentric part 30*b* of the control shaft 30 and is attached at the other end part at the top side in the cylinder axial direction (top side of cylinder block 2, that is, cylinder head 5 side) to a connecting pin 33 supported by the cylinder block 2. As shown in FIG. 2 and FIG. 3, in the present embodiment, two connecting members 31 connect the eccentric part 30*b* at one end side in the block long direction and the cylinder block 2, and the eccentric part 30*b* at the other end side in the block long direction and the cylinder block 2.

Note that in the present embodiment, the control shaft 30 is a so-called "crank shape", but it is also possible to fasten to the outer circumference of the main shaft part 30*a* eccentric cams with axial centers offset from axial center P3 of the main shaft part 30*a* and attach single end parts of the connecting members 31 to the outer circumferences of the eccentric cams.

Each connecting pin 33 is supported by a support part 23 provided at the side surface of one end side in the short direction of the cylinder block 2 (direction perpendicularly intersecting the block long direction and cylinder axial direction, below, "block short direction"). As shown in FIG. 2, in the present embodiment, one each support part 23 is provided at one end side and the other end side in the block long direction so as to correspond to the eccentric parts 30*b*.

The actuator 32 is a drive device for giving a drive torque to the control shaft 30 and making the control shaft 30 rotate in two directions within a predetermined range of rotational angle. In the present embodiment, an electric motor is used as the actuator 32.

In this way, the block movement mechanism 3 is arranged just at one of the left and right sides of the internal combustion engine 100 (in the present embodiment, one end side of the block short direction) when viewing the internal combustion engine 100 from the axial direction of the crankshaft 10 substantially matching the block long direction and is configured so as to make the cylinder block 2 move relative to the crankcase 1.

The guide mechanism 4 is a mechanism for keeping the cylinder block 2 from tilting in a direction different from the direction of movement and is provided with guide walls 40, support members 41, and pushing members 42.

The guide walls 40 are walls provided at the crankcase 1 so as to face the side surfaces of the cylinder block 2. They are arranged around the cylinder block 2 at predetermined spaces from the side surfaces of the cylinder block 2. Note that, in the following explanation, when particularly necessary to differentiate them, the guide wall 40 at one side of the internal combustion engine 100 in the block short direction will be referred to as the "guide wall 40*a*", while the guide wall 40 at the other end side of the block short direction will be referred to as the "guide wall 40*b*".

The support members 41 are members for supporting the side surfaces of the cylinder block 2. In the present embodiment, as shown in FIG. 2 and FIG. 3, two each are provided at each of the guide walls 40*a*, 40*b*. Further, as shown in FIG. 4, the support members 41 are attached to the guide walls 40*a*, 40*b* so that abutting surfaces 411 formed at single ends contact the side surfaces of the cylinder block 2.

The pushing members 42 are members for pushing the side surfaces of the cylinder block 2 toward the support members 41. In the present embodiment, as shown in FIG. 2 and FIG. 3, two each are provided at each of the guide walls 40*a*, 40*b*. As shown in FIG. 4, the pushing members 42 according to the present embodiment are provided with bodies 421 provided with opening parts, abutting plates 422 attached to the opening parts of the bodies 421 so as to be able to move in both directions in the block short direction, and springs 423 housed in the bodies 421 and applying to the abutting plates 422 pushing force pushing the abutting plates 422 continuously toward the side surfaces of the cylinder block 2. Further, the pushing members 42 are attached to the guide walls 40*a*, 40*b* so as to push the side surfaces of the cylinder block 2 toward the support members 41 by the abutting plates 422.

In this way, in the present embodiment, by supporting side surfaces of the cylinder block 2 of the internal combustion engine 100 at single sides by the support members 41 while pushing the side surfaces of the cylinder block 2 at the other sides by the pushing members 42, the cylinder block 2 is kept from tilting in a direction different from the cylinder axial direction. Further, the vibration caused during operation of the internal combustion engine 100 is kept from causing the cylinder block 2 to tilt in a direction different from the cylinder axial direction.

Note that as shown from FIG. 2 to FIG. 4, in the present embodiment, the support members 41 attached to the guide wall 40*a* at one end side in the block short direction forming the side of arrangement of the block movement mechanism 3 are positioned at the top side in the cylinder axial direction from the position of attachment of the other end part of the connecting member 31 (positions of support parts 23) while the pushing members 42 attached to the same guide wall 40*a* are arranged at the bottom side in the cylinder axial direction from the position of attachment of the other end part of the connecting member 31 (position of support part 23). Further, the support members 41 attached to the guide wall 40*b* at the other end side in the block short direction forming the opposite side from the side of arrangement of the block movement mechanism 3 are arranged at the bottom side in the cylinder axial direction from the pushing members 42 attached to the same guide wall 40*b*. The reason will be explained later referring to FIG. 8.

Further, as shown in FIG. 4, in the present embodiment, the facing support members 41 and pushing members 42 are arranged at the same heights in the cylinder axial direction. That is, the support members 41 attached to the guide wall 40*a* forming the side of arrangement of the block movement mechanism 3 and the pushing members 42 attached to the guide wall 40*b* forming the opposite side from the side of arrangement of the block movement mechanism 3 are arranged at the same heights in the cylinder axial direction. Further, the pushing members 42 attached to the guide wall 40*a* forming the side of arrangement of the block movement mechanism 3 and the support members 41 attached to the guide wall 40*b* forming the opposite side from the side of arrangement of the block movement mechanism 3 are arranged at the same heights in the cylinder axial direction. The reason will be explained later referring to FIG. 9.

Next, referring to FIG. 5 and FIG. 6, the operation of the block movement mechanism 3 will be explained.

Figure 5:
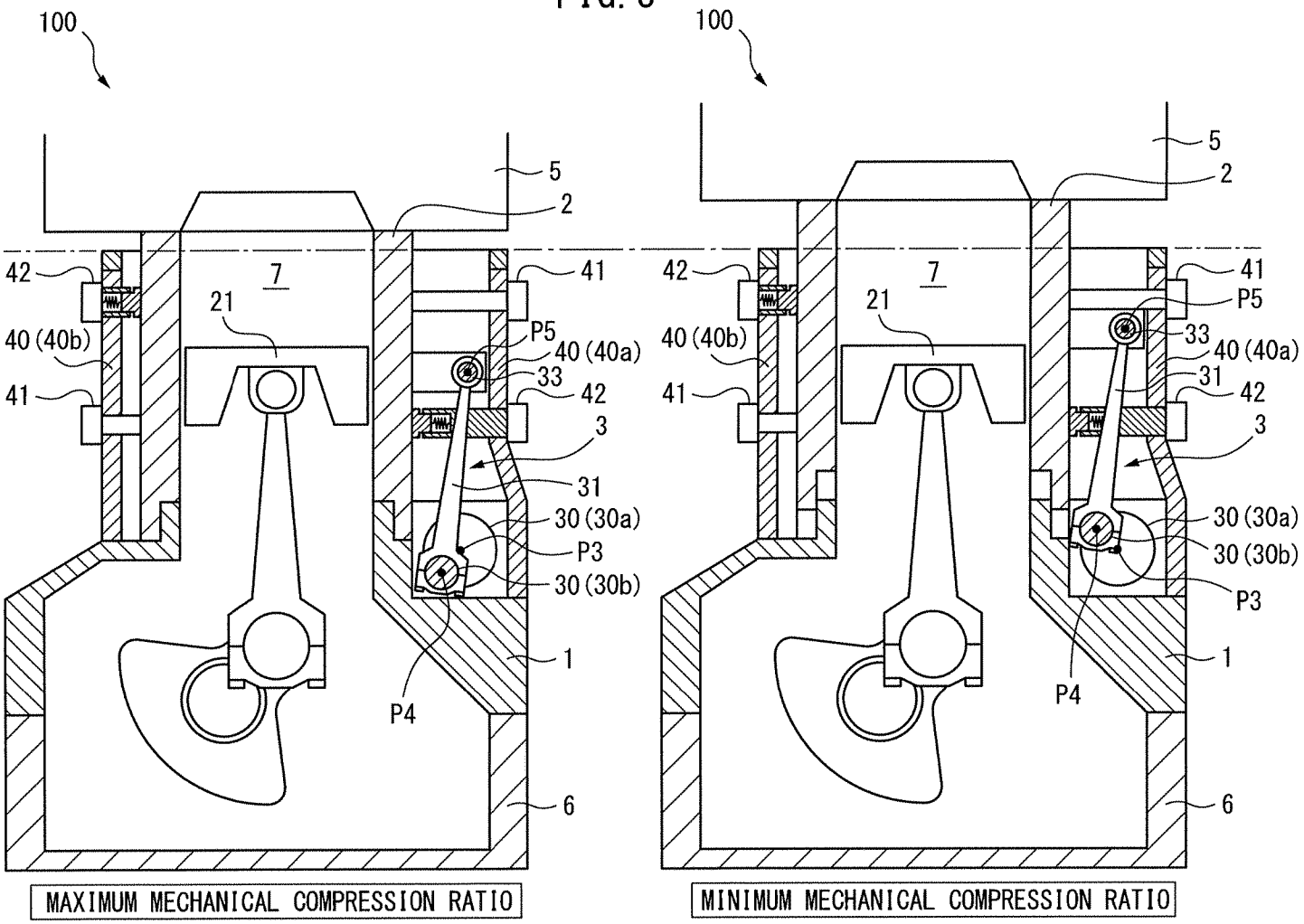
FIG. 5 is a view explaining the operation of a block movement mechanism.

FIG. 5 is a view showing by comparison the internal combustion engine 100 in the state making the volumes of the combustion chambers 7 when the pistons 21 are positioned at compression top dead center the minimum by the block movement mechanism 3, that is, in the state making the mechanical compression ratio maximum, and the internal combustion engine 100 in the state making the control shaft 30 rotate by exactly a predetermined rotational angle from that state to make the volumes of the combustion chambers 7 when the pistons 21 are positioned at compression top dead center the maximum, that is, in the state making the mechanical compression ratio minimum.

Figure 6:
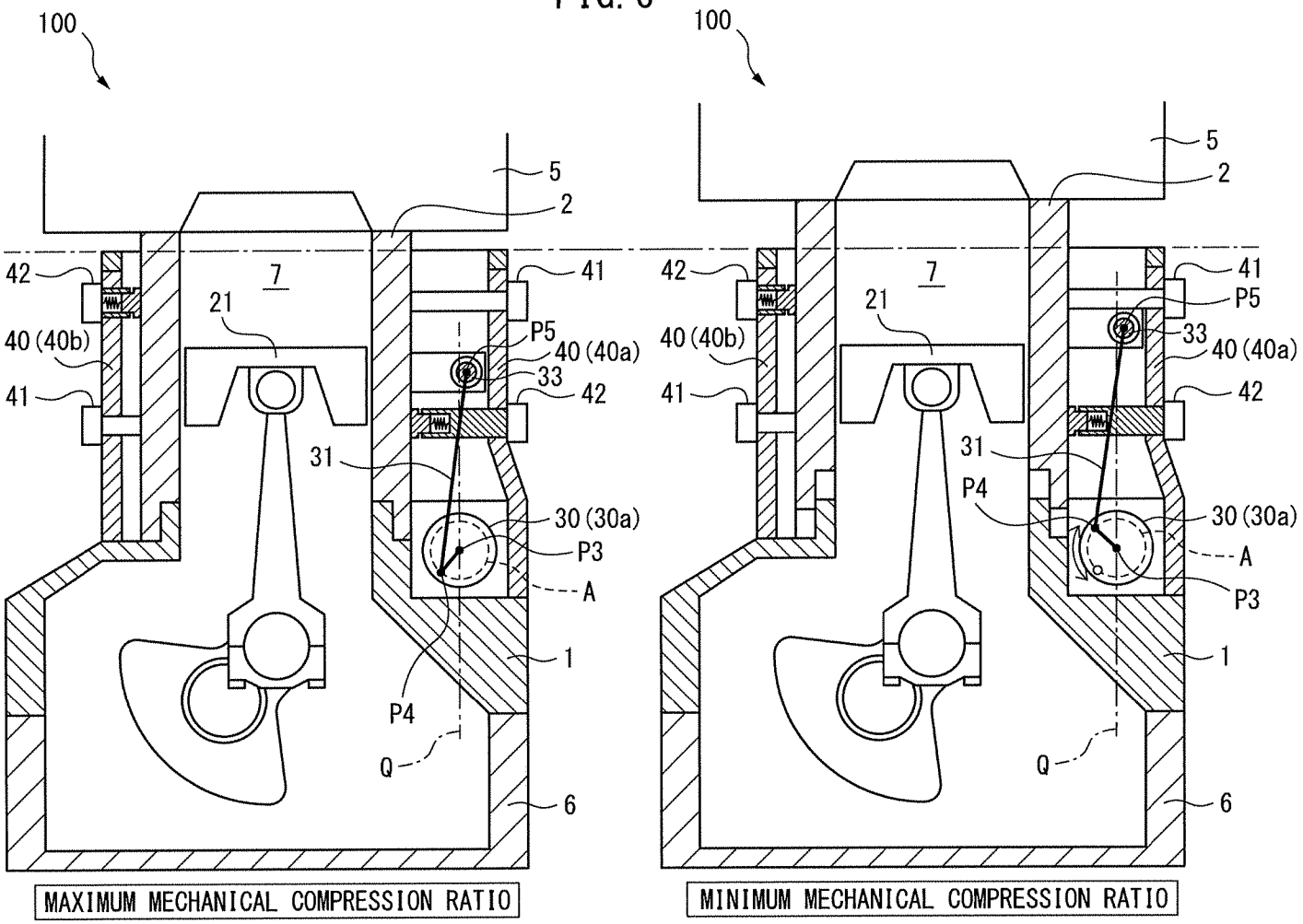
FIG. 6 is a view explaining the operation of the block movement mechanism and schematically showing the block movement mechanism.

FIG. 6 is a view, similar to FIG. 5, showing by comparison an internal combustion engine 100 in the state making the mechanical compression ratio the maximum and an internal combustion engine 100 in the state making the mechanical compression ratio the minimum. To facilitate understanding of the invention, it shows the block movement mechanism 3 schematically. Note that the broken line A in FIG. 6 shows the paths of the axial centers P4 of the eccentric parts 30*b* when making the control shaft 30 rotate by one turn. Further, P5 shows the axial centers of the connecting pins 33.

As shown in FIG. 6, in the present embodiment, when dividing the paths A of the axial centers P4 of the eccentric parts 30*b* into two semicircular regions by a parallel line Q passing through the axial center P3 of the main shaft part 30*a* and parallel to the cylinder axial direction, the actuator 32 is used to make the control shaft 30 rotate in both rotational directions so that the axial centers P4 move in both rotational directions within the range of either of the semicircular regions (in the present embodiment, the semicircular region at the left in the figure).

Further, the block movement mechanism 3 is configured so that, compared to the state making the mechanical compression ratio the minimum at the right side in the figure, when in the state making the mechanical compression ratio the maximum at the left side in the figure, the axial centers P4 of the eccentric parts 30*b* are positioned at the bottom side in the cylinder axial direction (bottom side of cylinder block 2, that is, crankshaft 10 side).

For this reason, for example, if using the actuator 32 to make the control shaft 30 rotate clockwise from the state making the mechanical compression ratio the maximum at the left side in the figure, the axial centers P4 of the eccentric parts 30*b* move on the paths A toward the top side in the cylinder axial direction (top side of cylinder block 2, that is, cylinder head 5 side). Due to this, the connecting pins 33 are pushed up linearly toward the top side in the cylinder axial direction through the connecting members 31 connected to the eccentric parts 30*b*, so the cylinder block 2 is pushed up to the top side of the cylinder axial direction relative to the crankcase 1. As a result, the volumes of the combustion chambers 7 when the pistons 21 are positioned at compression top dead center gradually increase and the mechanical compression ratio gradually becomes smaller.

On the other hand, for example, if using the actuator 32 to make the control shaft 30 rotate counterclockwise from the state making the mechanical compression ratio the minimum at the right side in the figure, the axial centers P4 of the eccentric parts 30*b* move on the paths A toward the bottom side in the cylinder axial direction. Due to this, the connecting pins 33 are pulled down linearly toward the bottom side in the cylinder axial direction through the connecting members 31 connected to the eccentric parts 30*b*, so the cylinder block 2 is pulled down to the bottom side of the cylinder axial direction relative to the crankcase 1. As a result, the volumes of the combustion chambers 7 when the pistons 21 are positioned at compression top dead center gradually decrease and the mechanical compression ratio gradually becomes larger.

In this way, the block movement mechanism 3 according to the present embodiment makes the control shaft 30 provided with the main shaft part 30*a* and eccentric parts 30*b* rotate to make the axial centers P4 of the eccentric parts 30*b* swing up and down in the cylinder axial direction about the axial center P3 of the main shaft part 30*a* to thereby make the cylinder block 2 move up and down in the cylinder axial direction by the connecting members 31 connected to the eccentric parts 30*b*.

In this regard, in the present embodiment, by providing such a block movement mechanism 3 at just one side in the internal combustion engine 100, enlargement of the internal combustion engine 100 is suppressed and increase of weight is suppressed. However, if providing the block movement mechanism 3 at just one side of the internal combustion engine 100, compared with when hypothetically providing block movement mechanisms 3 at the two sides of internal combustion engine 100, there is the problem that a block rotating force acts trying to make the cylinder block 2 rotate in a certain rotational direction during operation of the internal combustion engine 100. Below, this problem will be explained with reference to FIG. 7.

Figure 7:
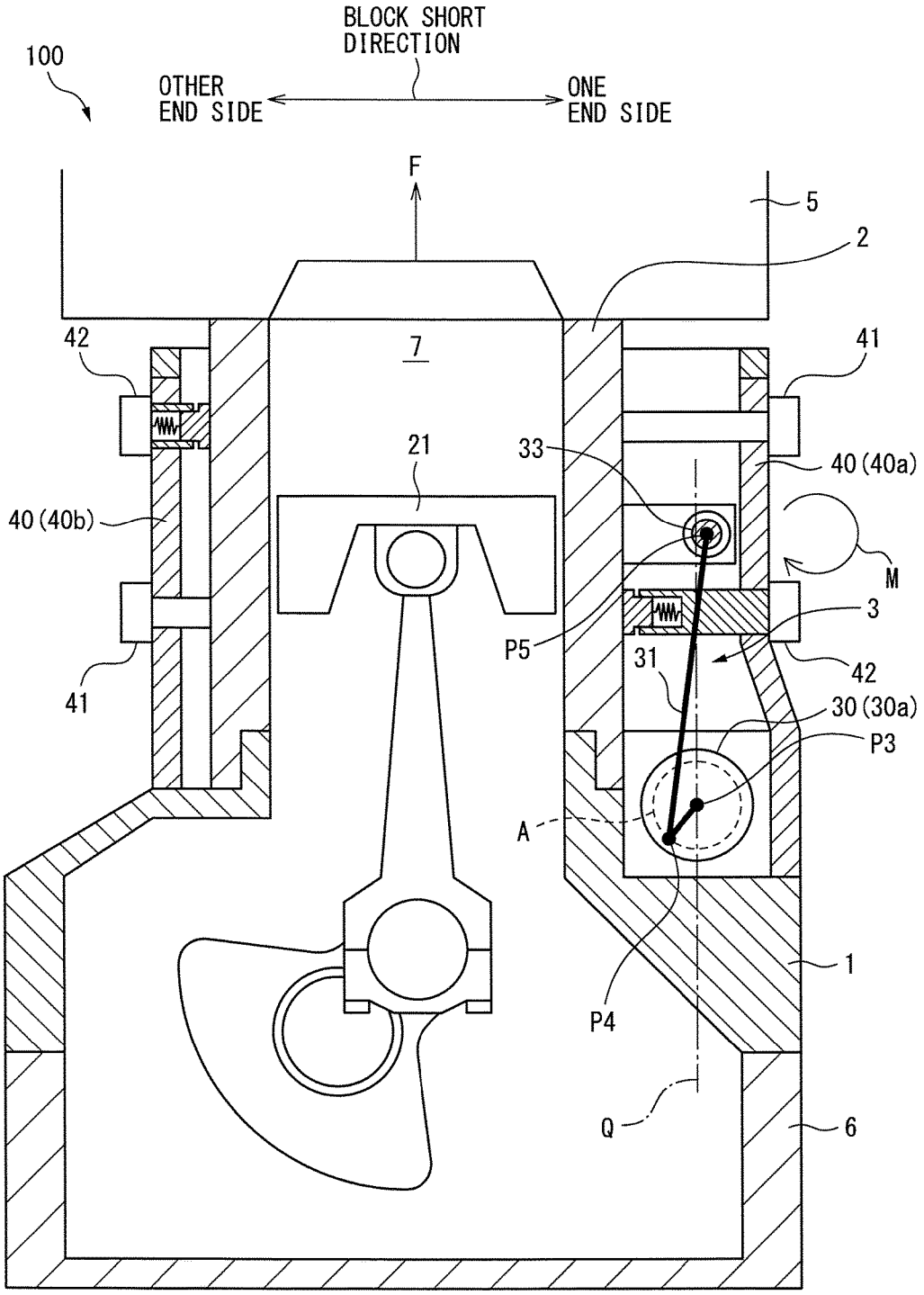
FIG. 7 is a view explaining the problem when providing the block movement mechanism at only one side of the internal combustion engine.

FIG. 7 is a view explaining the problem when providing the block movement mechanism 3 at just one side of the internal combustion engine 100 (in this example, one end side in the block short direction). Note that in FIG. 7, to facilitate understanding of the invention, the block movement mechanism 3 is schematically shown.

During operation of the internal combustion engine 100, fuel is burned inside the combustion chambers 7 of the cylinders 20, so as shown in FIG. 7, an upward combustion load F in the figure is applied to the cylinder head 5. At this time, when, as in the present embodiment, arranging the control shaft 30 at just one side of the internal combustion engine 100 and connecting the control shaft 30 and the cylinder block 2 by connecting members 31, due to the combustion load F applied to the cylinder head 5, a block rotating force trying to make the cylinder block 2 rotate clockwise in the figure about the other ends of the connecting members 31 is mainly generated. That is, a clockwise moment M in the figure about the axial center P5 is generated.

Here, even if providing block movement mechanisms 3 at the two sides of the internal combustion engine 100, for example, one end side and the other end side of the block short direction, a block rotating force trying to make the cylinder block 2 rotate clockwise about the other ends of connecting members 31 arranged along a side surface of the cylinder block 2 at one end side of the block short direction of the internal combustion engine 100 is generated. Further, conversely to this, a block rotating force trying to make the cylinder block 2 rotate counterclockwise about the other ends of connecting members 31 arranged along a side surface of the cylinder block 2 at the other end side of the block short direction of the internal combustion engine 100 is generated. For this reason, the block rotating force trying to make the cylinder block 2 rotate clockwise and the block rotating force trying to make it rotate counterclockwise are balanced and cancelled out and in appearance no block rotating force occurs at the cylinder block 2.

However, when providing a block movement mechanism 3 at just one side of the internal combustion engine 100, block rotating forces are not cancelled out such as in the case of providing them at the two sides. For this reason, when providing the block movement mechanism 3 at just one side of the internal combustion engine 100, during operation of the internal combustion engine 100, a block rotating force trying to make the cylinder block 2 rotate in a constant rotation direction is applied to the cylinder block 2. This block rotating force acts on the guide mechanism 4.

Figure 8:
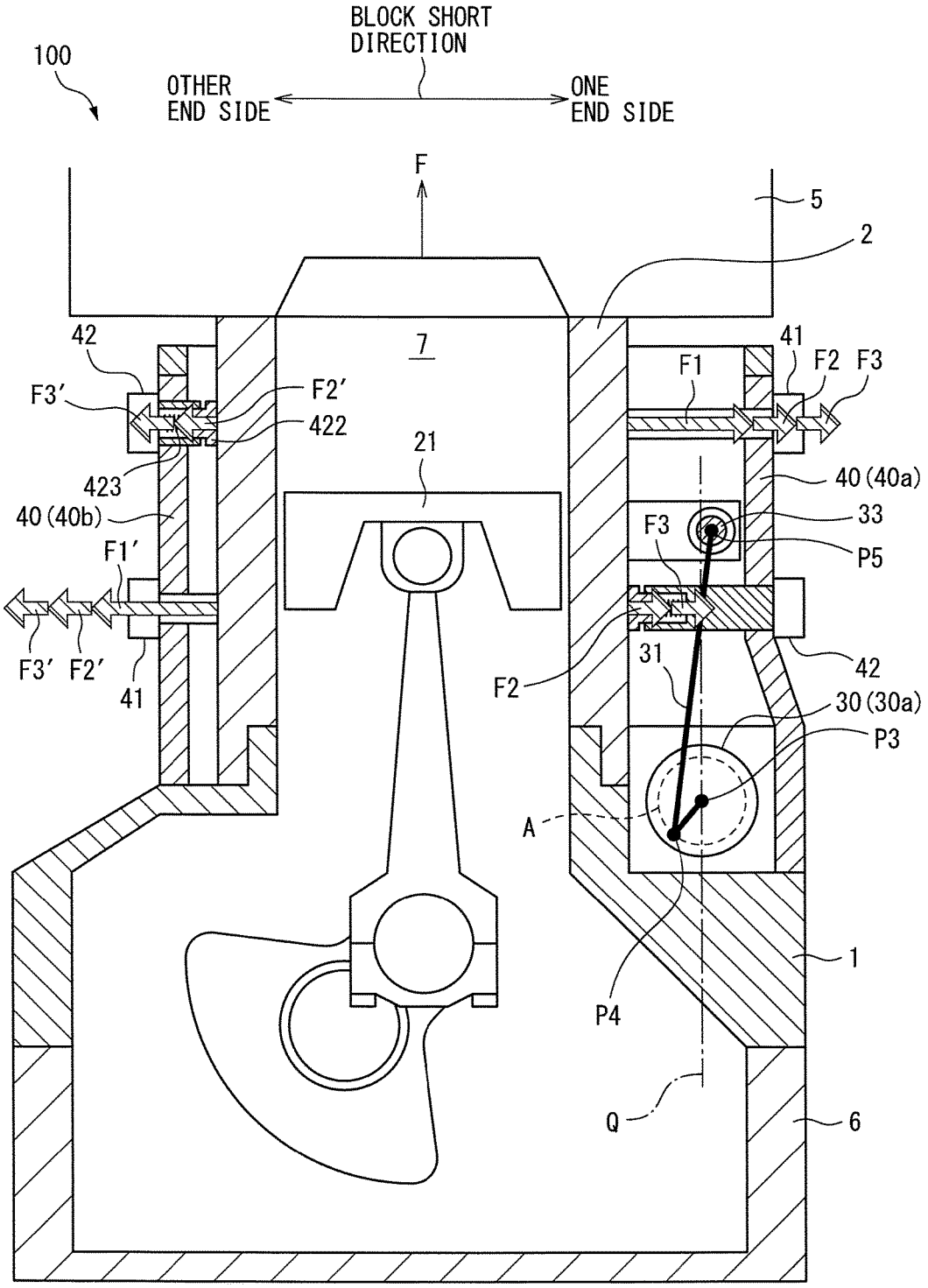
FIG. 8 is a view showing by arrows the forces acting on the support members and pushing members of the guide mechanism during operation of the internal combustion engine.

FIG. 8 is a view showing by arrows the forces acting on the support members 41 and pushing members 42 of the guide mechanism 4 during operation of the internal combustion engine 100.

In the example shown in FIG. 8, due to the combustion load F, a block rotating force is applied to the cylinder block 2 trying to make the cylinder block 2 rotate clockwise. That is, a force acts on the cylinder block 2 trying to make the cylinder block 2 tilt to the right side in the figure. For this reason, as shown in FIG. 8, for the support members 41 and pushing members 42 attached to the guide wall 40*a* at one end side in the block short direction forming the side of arrangement of the block movement mechanism 3, a block rotating force F1 derived from the combustion load F mainly acts on the support members 41 attached to the top side of the cylinder axial direction rather than the other end parts of the connecting members 31. Further, for the support members 41 and pushing members 42 attached to the guide wall 40*b* at the other end side in the block short direction forming the opposite side to the side of arrangement of the block movement mechanism 3, a block rotating force F1' derived from the combustion load F mainly acts on the support members 41 attached to the bottom side of the cylinder axial direction.

Further, during operation of the internal combustion engine 100, due to the tilt of the connecting rod 22 during the reciprocating motion of the piston 21, force in the block short direction (piston thrust force) acts on the cylinder block 2. Specifically, the piston reverse thrust force F2 pushing the cylinder block 2 to one end side in the block short direction and the piston forward thrust force F2' pushing the cylinder block 2 to the other end side of the block short direction are applied from the piston 21 to the cylinder block 2. For this reason, as shown in FIG. 8, a piston reverse thrust force F2 acts on the support members 41 and pushing members 42 attached to the guide wall 40*a* at one end side in the block short direction. Further, a piston forward thrust force F2' acts on the support members 41 and pushing members 42 attached to the guide wall 40*b* at the other end side in the block short direction.

Furthermore, when moving the cylinder block 2 in the cylinder axial direction, due to the tilt of the connecting members 31 of the block movement mechanism 3, forces in the block short direction (movement mechanism reverse thrust force F3 and movement mechanism forward thrust force F3') act on the cylinder block 2 from the connecting members 31.

In this way, in the present embodiment, the support members 41 are arranged at the parts where the block rotating forces F1 and F1' derived from the combustion load F act. Conversely speaking, pushing members 42 are not arranged at parts where the block rotating forces F1 and F1' derived from the combustion load F act. Below, the reason will be explained.

As explained above, in the present embodiment, the side surface of the cylinder block 2 at one side of the internal combustion engine 100 is supported by the support members 41 while the side surface of the cylinder block 2 at the opposite side is pushed against by the pushing members 42 so as to keep the cylinder block 2 from tilting in a different direction from the cylinder axial direction.

At this time, the support members 41 are fixed to the guide wall 40*a* and will not move, but the pushing members 42 push the abutting plates 422 against a side surface of the cylinder block 2 by the pushing forces of the springs 423. For this reason, if a force larger than the pushing forces of the springs 423 is applied from the cylinder block 2 side, the cylinder block 2 is liable to tilt to the pushing member 42 side. To prevent this, the pushing forces of the springs 423 may be made larger.

However, the pushing forces by the springs 423 are forces continuously acting against the side surface of the cylinder block 2, so the larger the pushing forces of the springs 423, the greater the forces of the pushing members 42 and the support members 41 gripping the cylinder block 2. For this reason, when moving the cylinder block 2, the resistance in the cylinder axial direction caused between the support members 41 and pushing members 42 and the cylinder block (below, referred to as the "sliding resistance") ends up increasing.

If the sliding resistance increases, the load when making the cylinder block 2 move in the cylinder axial direction, that is, the drive torque for making the control shaft 30 rotate, increases. For this reason, for example, when making the actuator 32 an electric motor, the amount of power consumption increases and as a result deterioration of the fuel efficiency is invited. Further, it is also necessary to raise the maximum drive torque of the actuator 32, so enlargement and increase in required capacity of the actuator 32 are invited and as a result enlargement and increase in weight of the internal combustion engine 100 are invited.

Here, if ending up arranging pushing members 42 at parts where the block rotating forces F1 and F1' derived from the combustion load F act, for the pushing members 42 at the guide wall 40*a* side, the pushing forces of the springs 423 have to be set to a pushing force of the composite force of the block rotating force F1, piston reverse thrust force F2, and movement mechanism reverse thrust force F3 or more. Further, for the pushing members 42 at the guide wall 40*b* side, the pushing forces of the spring 423 have to be set to a pushing force of the composite force of the block rotating force F1', piston forward thrust force F2', and movement mechanism forward thrust force F3' or more. That is, if ending up arranging pushing members 42 at parts where block rotating forces F1 and F1' derived from the combustion load F act, force of the composite force of these three forces or more continuously acts on the side surface of the cylinder block 2 from the pushing members 42.

On the other hand, like in the present embodiment, by arranging support members 41 and not arranging pushing members 42 at the parts where the block rotating forces F1 and F1' derived from the combustion load F act, for the pushing members 42 at the guide wall 40*a* side, the pushing forces of the springs 423 may be set to a pushing force of the composite force of the piston reverse thrust force F2 and movement mechanism reverse thrust force F3 or more. Further, for the pushing members 42 at the guide wall 40*b* side, the pushing forces of the springs 423 may be set to a pushing force of the composite force of the piston forward thrust force F2' and movement mechanism forward thrust force F3' or more.

In other words, in the present embodiment, the block rotating forces F1 and F1' do not act on the pushing members 42, so the pushing forces of the springs 423 can be set to lower values by that amount. In particular, the block rotating forces F1 and F1' derived from the combustion load F are much larger compared with the piston reverse thrust force F2, piston forward thrust force F2', movement mechanism reverse thrust force F3, and movement mechanism forward thrust force F3', so by preventing the block rotating forces F1 and F1' from acting on the pushing members 42, it is possible to greatly lower the pushing forces of the springs 423.

In this way, by arranging support members 41 and not arranging pushing members 42 at the parts where the block rotating forces F1 and F1' act, compared with when pushing against parts where the block rotating forces F1 and F1' act by the pushing members 42, the pushing forces of the springs 423 of the pushing members 42 can be reduced. Therefore, it is possible to reduce the sliding resistance when moving the cylinder block 2 in the cylinder axial direction. As a result, deterioration of the fuel efficiency and enlargement and increase of required capacity of the actuator can be suppressed. For this reason, enlargement and increase of weight of the internal combustion engine 100 can be further suppressed.

Next, referring to FIG. 9A and FIG. 9B, the reason for arranging the facing support members 41 and pushing members 42 at the same heights in the cylinder axial direction will be explained.

Figure 9A:
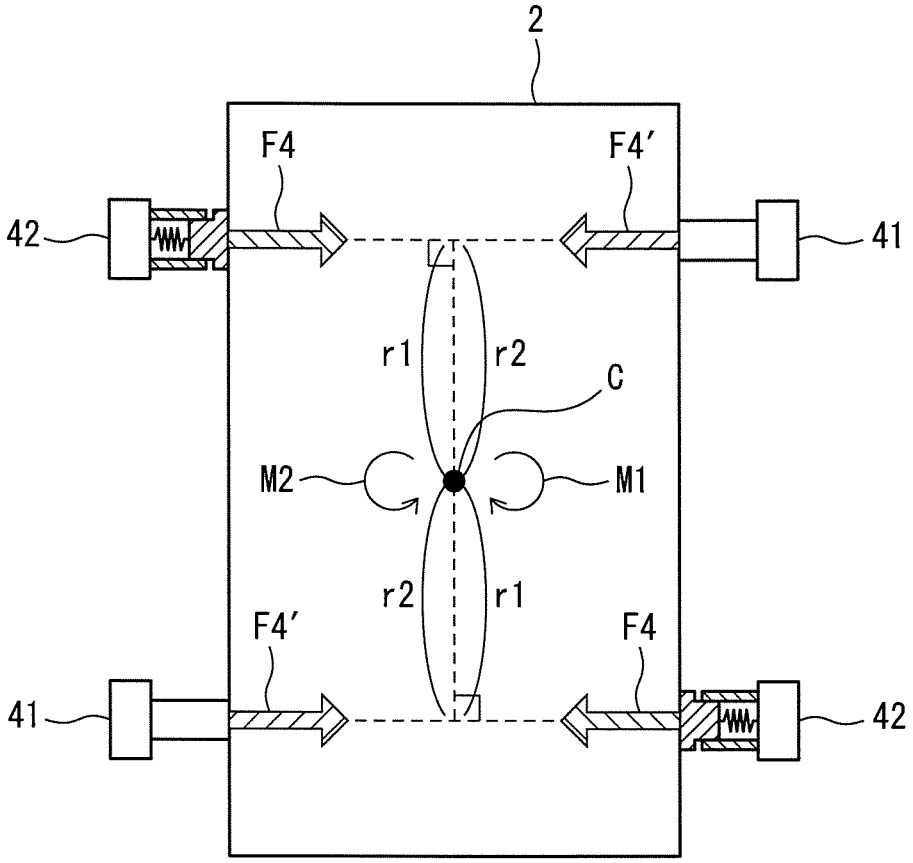
FIG. 9A is a view explaining the reason for arranging facing support members and pushing members at the same heights in the cylinder axial direction.

FIG. 9A is a view showing the forces acting on the cylinder block 2 due to the pushing forces of the pushing members 42 when, like in the present embodiment, arranging the facing support members 41 and pushing members 42 at the same heights in the cylinder axial direction. On the other hand, FIG. 9B is a view showing one example of the forces acting on the cylinder block 2 due to the pushing forces of the pushing members 42 when, unlike in the present embodiment, arranging the facing support members 41 and pushing members 42 at different heights in the cylinder axial direction.

Figure 9B:
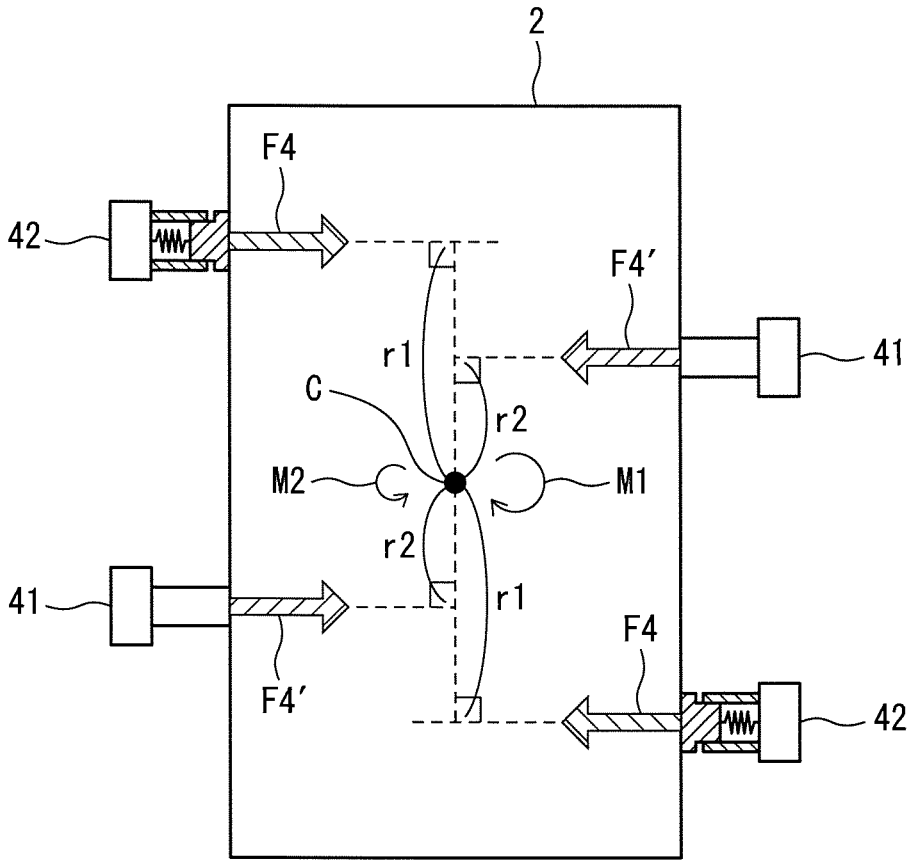
FIG. 9B is a view explaining the reason for arranging facing support members and pushing members at the same heights in the cylinder axial direction.

As shown in FIG. 9A and FIG. 9B, a pushing force F4 acts on the cylinder block 2 from the pushing members 42 and a reaction force F4' (=F4) acts from the support members 41.

At this time, as shown in FIG. 9A, when arranging the facing support members 41 and pushing members 42 at the same heights in the cylinder axial direction, the length of the moment arm r1 of the moment M1 in the clockwise direction generated about the center of gravity C of the cylinder block 2 due to the pushing force F4 of the pushing members 42 and the length of the moment arm r2 of the moment M2 in the counterclockwise direction generated about the center of gravity C of the cylinder block 2 due to the reaction force F4' become equal. For this reason, the magnitudes of the moment M1 (=F4×r1) and the moment M2 (=F4'×r2) become equal, so the moment M1 and the moment M2 are cancelled out and in appearance no moment is generated about the center of gravity C of the cylinder block 2.

On the other hand, for example, as shown in FIG. 9B, when arranging the facing support members 41 and pushing members 42 at different heights in the cylinder axial direction, the length of the moment arm r1 and the length of the moment arm r2 differ. For this reason, in the example of FIG. 9B, the moment M1 (=F4×r1) becomes larger than the moment M2 (=F4'×r2) and a moment ends up generated about the center of gravity C of the cylinder block 2. As a result, the force derived from this moment ends up acting on the support members 41 or pushing members 42, so the sliding resistance ends up increasing.

Therefore, in the present embodiment, the facing support members 41 and pushing members 42 are arranged at the same heights in the cylinder axial direction. Due to this, it is possible to prevent the generation of a moment about the center of gravity C of the cylinder block 2, so it is possible to suppress an increase in the sliding resistance.

According to the above explained embodiment, there is provided an internal combustion engine 100 including a cylinder block 2 able to move relative to a crankcase 1, wherein the internal combustion engine 100 is provided with a block movement mechanism 3 arranged at only one side of the internal combustion engine 100 when viewing the internal combustion engine 100 from an axial line direction of the crankshaft 10 supported at the crankcase 1 to be able to freely rotate and making the cylinder block 2 move relative to the crankcase 1, a pair of guide walls 40*a*, 40*b* provided at the left and right of the crankcase 1 so as to face side surfaces of the cylinder block 2, support members 41 attached to the guide wall 40*a* at the side of arrangement of the block movement mechanism 3 and the guide wall 40*b* at the opposite side and supporting the side surfaces of the cylinder block 1, and pushing members 42 attached to the guide wall 40*a* at the side of arrangement of the block movement mechanism 3 and the guide wall 40*b* at the opposite side and pushing the side surfaces of the cylinder block 2.

The block movement mechanism 3 is configured so as to be provided with a single control shaft 30 supported by the crankcase 1 and having a main shaft part 30*a* and eccentric parts 30*b* with axial centers P4 at positions offset from the axial center P3 of the main shaft part 30*a* by predetermined amounts, connecting members 31 with one end parts attached to the eccentric parts 30*b* and with other end parts attached to the cylinder block 2 for connecting the control shaft 30 and the cylinder block 2, and an actuator 32 for making the control shaft 30 rotate in two directions within a predetermined range of rotation to make the axial centers of the eccentric parts 30*b* swing in the direction of relative movement of the cylinder block 2 about the axial center of the main shaft part 30*a*.

Further, at the guide wall 40*a* at the side of arrangement of the block movement mechanism 3, the support members 41 are attached to the top side of the cylinder block 2 in the direction of relative movement from the positions of attachment of the other end parts of the connecting members 31 (positions of support parts 23, axial center P5) and the pushing members 42 are attached to the bottom side of the cylinder block 2 in the direction of relative movement from the positions of attachment of the other end parts of the connecting members 31 (bottom side of cylinder block 2). Further, at the guide wall 40*b* at the opposite side to the side of arrangement of the block movement mechanism 3, the support members 41 are attached at the bottom side of the cylinder block 2 predetermined spaces away from the pushing members 42 in the direction of relative movement of the cylinder block 2 (bottom side of cylinder block 2).

Due to this, according to the internal combustion engine 100 according to the present embodiment, just by making the single control shaft 30 rotate, it is possible to make the cylinder block 2 move relative to the crankcase 1 through the connecting members 31. For this reason, it is sufficient to arrange a single control shaft 30 for example in parallel with the crankshaft 10 at just one side of the internal combustion engine 100. As a result, it is possible to arrange the block movement mechanism 3 at just one side of the internal combustion engine. Therefore, there is no need to provide eccentric shafts at the two sides of the internal combustion engine 100 like in the above-mentioned conventional internal combustion engine. Further, there is no need to provide a drive shaft for making the two eccentric shafts rotate, so it is possible to suppress enlargement of the internal combustion engine 100 provided with a cylinder block 2 able to move relative to a crankcase 1 and suppress an increase of weight.

Further, when arranging such a configuration of a block movement mechanism 3 at just one side of the internal combustion engine 100, a moment M about the axial center P5 is mainly generated by the combustion load F and block rotating forces F1 and F1' act on the cylinder block 2 making the cylinder block 2 rotate to the block movement mechanism 3 side. For this reason, like in the present embodiment, by attaching the support members 41 at the top side of the cylinder block 2 in the direction of relative movement from the positions of attachment of the other end parts of the connecting members 31 (axial centers P5) and attaching the pushing members 42 at the bottom side of the cylinder block 2 in the direction of relative movement from the positions of attachment of the other end parts of the connecting members 31 (axial centers P5) at the guide wall 40*a* of the side of arrangement of the block movement mechanism 3 and by attaching the support members 41 at the bottom side in the direction of relative movement of the cylinder block 2 predetermined spaces from the pushing members 42 at the guide wall 40*b* at the opposite side to the side of arrangement of the block movement mechanism 3, it is possible to support the side surfaces of the cylinder block 2 where the block rotating forces F1 and F1' act by the support members 41.

Therefore, compared with when the pushing members 42 push against the parts where large block rotating forces F1 and F1' derived from the combustion load F act, it is possible to reduce the pushing forces of the springs 423 of the pushing members 42. Accordingly, it is possible to reduce the sliding resistance when moving the cylinder block 2 in the cylinder axial direction. As a result, it is possible to suppress deterioration of the fuel efficiency and enlargement and increase in required capacity of the actuator. For this reason, it is possible to further suppress the enlargement and increase in weight of the internal combustion engine 100.

In particular, according to the internal combustion engine 100 according to the present embodiment, the support members 41 attached to the guide wall 40*a* at the side of arrangement of the block movement mechanism 3 and the pushing members 42 attached to the guide wall 40*b* at the opposite side from the side of arrangement of the block movement mechanism 3 are arranged at the same heights in the direction of relative movement of the cylinder block. Further, the pushing members 42 attached to the guide wall 40*a* at the side of arrangement of the block movement mechanism 3 and the support members 41 attached to the guide wall 40*b* at the opposite side from the side of arrangement of the block movement mechanism 3 are arranged at the same heights in the direction of relative movement of the cylinder block.

For this reason, due to the pushing forces of the pushing members 42, it is possible to suppress the generation of a moment around the center of gravity C of the cylinder block 2, so it is possible to suppress an increase in the sliding resistance. As a result, it is possible to further suppress deterioration of the fuel efficiency and enlargement and increase in required capacity of the actuator and possible to further suppress enlargement and increase in weight of the internal combustion engine 100.

Above, an embodiment of the present invention was explained, but the above embodiment only shows part of the examples of application of the present invention. It is not intended to limit the technical scope of the present invention to the specific configuration of the above embodiment.

For example, in the above embodiment, use was made of pushing members 42 of a configuration using the biasing force of a spring 423 to push an abutting plate 422 against a side surface of the cylinder block 2, but the configuration of the pushing members 42 is not limited to such a configuration.

Figure 10:
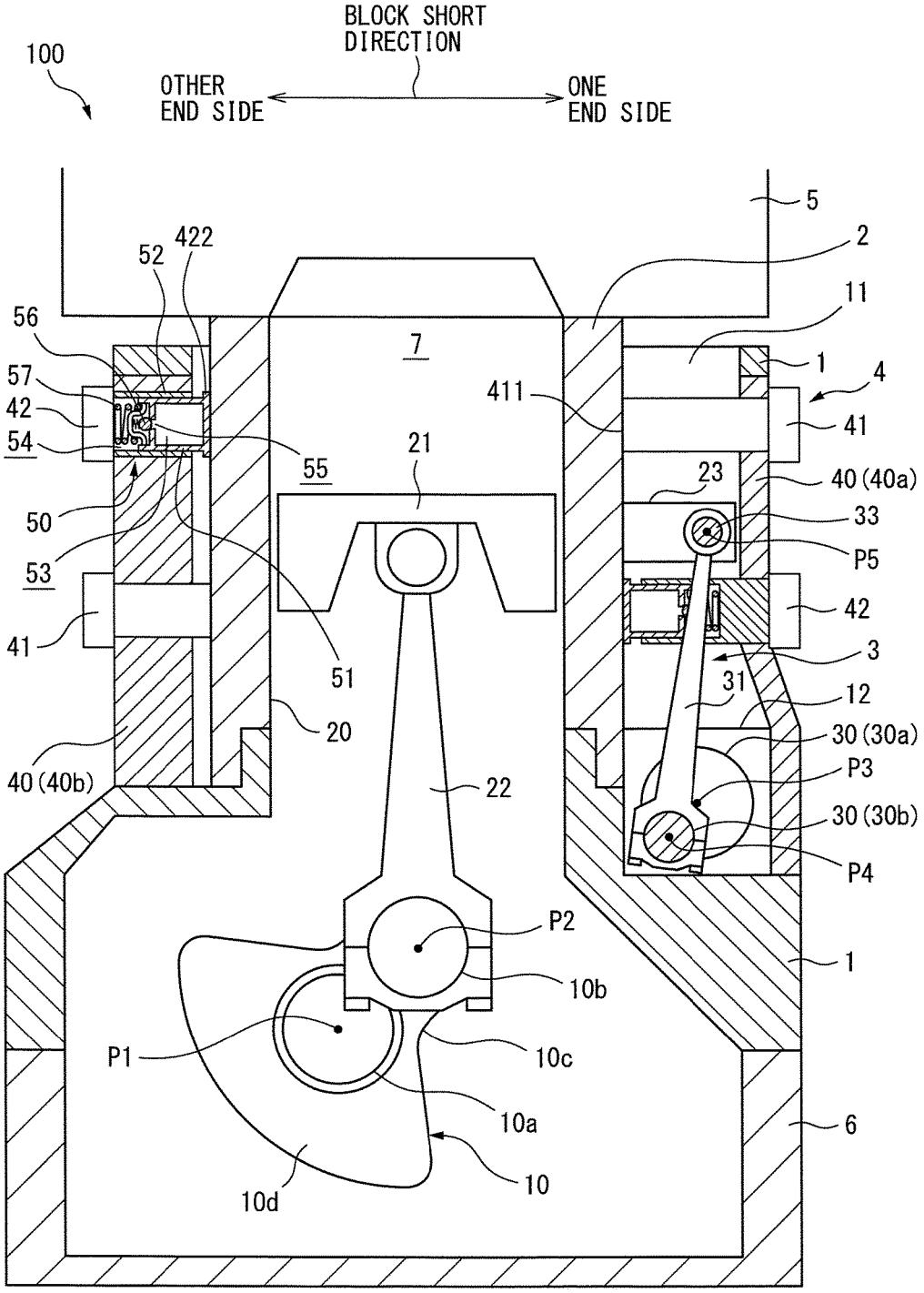
FIG. 10 is a view showing a modification of an internal combustion engine according to one embodiment of the present disclosure.

For example, as shown in FIG. 10, it is also possible to provide oil paths (not shown) connecting with first hydraulic chambers 53 inside of the guide walls 40 and use hydraulic type lash adjusters 50 as the pushing members 42 to push abutting plates 422 against a side surface of the cylinder block 2 and make the clearances between the abutting plates 422 and the side surface of the cylinder block 2 zero at all times.

Each lash adjuster 50 is provided with a plunger 51 integrally joined with the abutting plate 422, a body 52 holding the plunger 51, a first hydraulic chamber 53 formed at the inside of the plunger 51, a second hydraulic chamber 54 formed at the inside of the body 52, a check ball 56 sealing a communication path 55 connecting the first hydraulic chamber 53 and the second hydraulic chamber 54, and a spring 57 arranged at the inside of the second hydraulic chamber 54 and continuously pushing the plunger 51 to the cylinder block 2 side.

The lash adjuster 50 pushes the plunger 51 up by the spring force of the spring 57 when no load is applied from the cylinder block 2 side to thereby make the abutting plate 422 abut against the side surface of the cylinder block 2 and hold the clearance between the abutting plate 422 and the side surface of the cylinder block 2 continuously at zero. On the other hand, if a load from the cylinder block 2 side is applied to the abutting plate 422, the plunger 51 is pushed down and due to the check ball 56 the second hydraulic chamber 54 is sealed and becomes a high pressure. As a result, due to the hydraulic pressure of the second hydraulic chamber 54, the position of the plunger 51 is fixed at a predetermined position and the abutting plate 422 is pushed against the side surface of the cylinder block 2.

When using as the pushing members 42 members of a configuration like in the above embodiment using the biasing forces of springs 423 to push the abutting plates 422 against the side surface of the cylinder block 2, the pushing forces of the springs 423 continuously act against the cylinder block 2.

On the other hand, when using lash adjusters 50 as the pushing members 42, when no load is applied from the cylinder block 2 side, only the spring forces of the springs 57 act against the cylinder block 2. The lash adjusters 50 makes hydraulic pressure corresponding to a load applied from the cylinder block 2 side act to suppress tilt of the cylinder block 2 when such a load is applied, so the spring forces of the springs 57 of the lash adjusters 50 can be made smaller than the spring forces of the springs 423 of the above embodiment. Therefore, by using lash adjusters 50 as the pushing members 42, it is possible to reduce the sliding resistance when a large load is not being applied from the cylinder block 2 side.

Further, in the above embodiment, the connecting members 31 were tilted toward the outside direction of the block, but it is also possible to tilt the connecting members 31 toward the inside direction of the block so that the other end parts of the connecting members 31 are positioned at the cylinder block 2 side with respect to the one end parts.

Further, in the above embodiment, two connecting members 31 were used to connect the eccentric parts 30*b* of the control shaft 30 and the cylinder block 2, but the number of connecting members 31 is not limited to two and can be changed in accordance with need.

The invention claimed is:

1. An internal combustion engine including a cylinder block able to move relative to a crankcase and a cylinder head attached to a top part of the cylinder block, the internal combustion engine comprising:

a block movement mechanism arranged at only one side of the internal combustion engine when viewing the internal combustion engine from an axial line direction of the crankshaft supported at the crankcase to be able to freely rotate and making the cylinder block move relative to the crankcase;

a pair of guide walls provided at the crankcase so as to face side surfaces of the cylinder block;

support members attached to the guide wall at the side of arrangement of the block movement mechanism and the guide wall at the opposite side and supporting the side surfaces of the cylinder block; and pushing members attached to the guide wall at the side of arrangement of the block movement mechanism and the guide wall at the opposite side and pushing the side surfaces of the cylinder block, the block movement mechanism provided with:

a single control shaft supported by the crankcase and having a main shaft part and an eccentric part with an axial center at a position offset by a predetermined amount from the axial center of the main shaft part;

a connecting member with one end part attached to the eccentric part and with the other end part attached to the cylinder block and connecting the control shaft and the cylinder block; and an actuator making the control shaft rotate in two directions within a predetermined range of rotational angle to make the axial center of the eccentric part swing in the direction of relative movement of the cylinder block about the axial center of the main shaft part, at the guide wall at the side of arrangement of the block movement mechanism, the support member being attached to the top side of the cylinder block from the position of attachment of the other end part of the connecting member and the pushing member being attached to the bottom side of the cylinder block from the position of attachment of the other end part of the connecting member, and at the guide wall at the opposite side to the side of arrangement of the block movement mechanism, the support member being attached at the bottom side of the cylinder block a predetermined space away from the pushing member in the direction of relative movement of the cylinder block.

2. The internal combustion engine according to claim 1, wherein the support member attached to the guide wall at the side where the block movement mechanism is arranged and the pushing member attached to the guide wall at the opposite side from the side of arrangement of the block movement mechanism are arranged at the same heights in the direction of relative movement of the cylinder block.

3. The internal combustion engine according to claim 1, wherein the pushing member attached to the guide wall at the side where the block movement mechanism is arranged and the support member attached to the guide wall at the opposite side from the side of arrangement of the block movement mechanism are arranged at the same heights in the direction of relative movement of the cylinder block.

* * * * *